US010092947B2

(12) United States Patent
Polzin et al.

(10) Patent No.: US 10,092,947 B2
(45) Date of Patent: Oct. 9, 2018

(54) METHOD FOR PRODUCING LOST CORES OR MOLDED PARTS FOR THE PRODUCTION OF CAST PARTS

(71) Applicant: Peak Deutschland GmbH, Nossen (DE)

(72) Inventors: Hartmut Polzin, Striegistal (DE); Theo Kooyers, Leuvenheim (NL); Matthias Strehle, Leuben-Schleinitz (DE); Frank Gleissner, Schönheide (DE)

(73) Assignee: Peak Deutschland GmbH, Nossen (DE)

( * ) Notice: Subject to any disclaimer, the term of this patent is extended or adjusted under 35 U.S.C. 154(b) by 333 days.

(21) Appl. No.: 15/030,052

(22) PCT Filed: Oct. 17, 2014

(86) PCT No.: PCT/EP2014/072361
§ 371 (c)(1),
(2) Date: Apr. 16, 2016

(87) PCT Pub. No.: WO2015/055838
PCT Pub. Date: Apr. 23, 2015

(65) Prior Publication Data

US 2016/0250680 A1 Sep. 1, 2016

(30) Foreign Application Priority Data

Oct. 19, 2013 (DE) ..... 10 2013 017 390

(51) Int. Cl.

| | |
|---|---|
| ***B22C 1/18*** | (2006.01) |
| ***B22C 9/02*** | (2006.01) |
| ***B22C 15/24*** | (2006.01) |
| ***B22C 1/16*** | (2006.01) |
| ***B22C 9/10*** | (2006.01) |

(52) U.S. Cl.
CPC ..... *B22C 1/188* (2013.01); *B22C 1/162* (2013.01); *B22C 1/181* (2013.01); *B22C 1/183* (2013.01); *B22C 9/02* (2013.01); *B22C 9/10* (2013.01); *B22C 15/24* (2013.01)

(58) Field of Classification Search
CPC ..... B22C 1/188; B22C 1/162; B22C 1/181; B22C 1/183; B22C 9/02; B22C 9/10; B22C 15/24
See application file for complete search history.

(56) References Cited

FOREIGN PATENT DOCUMENTS

| | | | |
|---|---|---|---|
| CN | 85105348 | A | 12/1986 |
| CN | 1344187 | A | 4/2002 |
| CN | 1453082 | A | 11/2003 |
| CN | 1721103 | A | 7/2006 |
| CN | 102059336 | A | 5/2011 |
| CN | 102773402 | A | 11/2012 |
| DE | 2434431 | A1 | 2/1975 |
| DE | 102007023883 | A1 | 11/2008 |
| DE | 102007027577 | A1 | 12/2008 |
| DE | 202008017975 | U1 | 3/2011 |
| DE | 102012020510 | A1 | 4/2014 |
| EP | 2163328 | A1 | 3/2010 |
| WO | 2008046651 | A1 | 4/2008 |

*Primary Examiner* — Kevin P Kerns
*Assistant Examiner* — Steven S Ha
(74) *Attorney, Agent, or Firm* — Michael Soderman

(57) ABSTRACT

The invention relates to a method for producing lost cores or molded parts for the production of cast parts, in which a basic molding material is mixed with an alkali silicate or water glass binder and a lost core or a molded part for the production of cast parts is formed using a core shooter in a core box, wherein the alkali silicate or water glass binder contains an alkali silicate or water glass solution having a modulus of 1.5 to 3.5 and natural and/or synthetic additives in a proportion of 0.1 to 25% by weight measured with respect to the total amount of binder, with a particle size of less than 5 μm and the natural and/or synthetic additives are at least aluminum silicate, magnesium silicate and sodium aluminum silicate, each having a proportion of 1 to 5% by weight measured with respect to the total amount of binder. The lost core or the other molded part is formed in an unheated core box, and the lost core thus formed or the molded part is cured using hot air.

17 Claims, No Drawings

METHOD FOR PRODUCING LOST CORES OR MOLDED PARTS FOR THE PRODUCTION OF CAST PARTS

CROSS REFERENCE TO RELATED APPLICATIONS

This application is the U.S. national stage of International Application No. PCT/EP2014/072361, filed on Oct. 17, 2014, and claims the priority thereof. The international application claims the priority of German Application No. DE 10 2013 017 390.6 filed on Oct. 19, 2013; all applications are incorporated by reference herein in their entirety.

BACKGROUND

The invention relates to the production of lost cores or moulded parts for casting moulds in order to produce cast components (cast part production). Lost cores are required in the casting industry for the production of voids inside cast parts and may have an extremely complex structure, for example cores for vehicle cylinder heads.

The lost cores are produced from a grainy and dry basic moulding material, a sand, usually quartz sand, but also from chromite, zirconia, olivine, feldspar, mullite or other sands and a chemically hardening binder system. These components are mixed, if necessary with the addition of further additives and by applying pressure (compressed air) to the moulding die (core or mould box). Subsequent solidification of the moulding mixture, which is still loosely packed, can be carried out by various methods, for example by the passage of a hardening gas, for example carbon dioxide, or a thermal solidification using a heated, i.e. metallic moulding die.

Binders which are based on water glass are known which usually consist of multi-component systems formed by the water glass component and an additive component which is usually in powder form. Mixed with basic moulding materials and moulded into cores or moulded core parts, moulded parts of this type can be solidified by physical solidification (dehydration, removal of water, drying) or chemical solidification (chemical hardening).

The known INOTEC process uses a binder mixture based on sodium silicate as the binder, whereby the properties of this moulding material are improved by adding additives, known as INOTEC promoters. Hardening in this case is carried out by means of a stepwise dehydration of the core moulding material using die temperatures between 150° C. and 250° C. as well as subsequently flushing with hot air in the same temperature range. Depending on the quality of the sand, binder contents of between 1.8% and 2.5% and promoter contents of between 0.1% and 1.0% are used. The promoter improves, inter alia, the flowability and strength of the core moulding material and the core by binding individual binder particles together and forming a three-dimensional network.

The main areas of application of the INOTEC process and the INOTEC binder are light metal and non-ferrous metal alloys, for example for the production of cylinder heads, and also for valve body casting.

In addition, a CORDIS binder system is known, in which the binder comprises a matrix formed from a combination of phosphate, borate and silicate groups. The CORDIS binder system is an inorganic two-component system which is composed of the CORDIS binder and the additive Anorgit. To use this binder system, a heated core box (130° C. to 180° C.) as well as a hot air flush (100° C. to 200° C.) are necessary. The binder quantities employed can be between 1.5% and 3.0%, depending on the type of binder. In this manner, bending strengths of 350 to 550 N/cm$^2$ are obtained.

The CORDIS binder system is also used for the production of inorganic bonded cores in temperature-controlled core production dies. The CORDIS binder system is composed of water as the solvent and an inorganic binder matrix. Depending on the application, this binder matrix consists of a combination of modified phosphate, silicate and borate groups. Furthermore, by adding inorganic substances directly to the binder or by means of an additive during production of the core, the properties can be specifically altered. Examples of these include flowability, reactivity of the moulding mixture, wetting of the core by the melt or the shelf life.

The problem with this binder is that the shelf life of bonded cores is limited because of its hydrophilic nature. As an example, when stored for 24 hours, the strength drops by approximately ⅓ of the starting strength. Preferably, the CORDIS binder systems are used for aluminium gravity shell casting.

A further alternative for the emission-free production of inorganic cores is what is known as the AWB (inorganic hot box) process. The AWB process is also operated with heated core boxes (160° C. to 200° C.). When the core is shot, a vacuum is applied to the core box which acts to remove the steam which is formed. Hardening is purely physical in nature, which has a positive influence on regeneration of the moulding material following casting. After the core in the core box has reached a certain processing strength, it is completely hardened in a microwave oven at low power.

The AWB process is based on thermal hardening of water glass-bonded moulding materials in a temperature-controlled die with subsequent microwave drying. The binder is a modified water glass which has a low viscosity by being diluted with sodium hydroxide. The flowability of the moulding material mixtures produced in this manner and thus their shot capabilities leads to good production of the core or moulded part. Solidification of the moulding material in the AWB process is exclusively obtained via dehydration, i.e. drying at die temperatures between 160° C. and 200° C., wherein in addition, a vacuum can be applied. The subsequent drying is then carried out using low power microwave ovens. The binder contents are between 1.5% and 2.5%. No additives are used.

DE 103 21 106 A1 discloses a moulding material for moulded parts from casting moulds for casting light metal melts, wherein the basic moulding material used is a quartz-free sand (olivine) and an inorganic binder based on water glass.

Powdered water glass systems are also known in which spray dried water glass is used as the binder. However, the disadvantage here is that this powdered binder is constituted by microfine particles which pollute the air at the foundry site.

Two-component binder systems are known in the prior art. DE 20 2008 017 975 U1 discloses a two-component system formed by a first liquid, water glass and a second solid, a component containing a particulate metallic oxide. In addition, a surfactant is added, preferably to the liquid component. The particle size of the metallic oxide here is less than 100 μm and more than 10 μm. The disadvantage here is that this binder requires the addition of a surfactant. In addition, the binder is prepared as a two-component system and must firstly be mixed together in a complicated manoeuvre prior to use.

DE 2434431 A1 discloses a binder system based on water glass, wherein the mixtures of moulding material formed contain a series of additional components in addition to the basic moulding material and the binder. The binder has a ratio of silica to alkaline oxide of between 3.5:1 and 10:1 and is added to the basic moulding material in proportions of between 3% and 15% by weight. The additives which are used for this multi-component system are clay or alumina, carbonaceous materials (for example pitch or carbon black) as well as film-forming resin binders (for example polyvinylacetate dispersions or vinyl acetate-ethylene copolymers).

DE 10 2012 020 510 A1 discloses a mixture of moulding materials formed from a refractory basic moulding material, an inorganic binder based on water glass as well as particulate amorphous $SiO_2$. It also contains additional organic additives as well as various surfactants with a system that functions as a two-component binder. The particulate amorphous $SiO_2$ is added as a powder in this instance. The moulding material mixture contains a hardener (for example an ester or phosphate compound) and is suitable for use in aluminium casting. The moulding material mixture is hardened with the aid of hot dies which are preferably heated to 120° C. to 250° C.

DE 10 2007 027 577 A1 discloses a moulding material mixture which, in addition to the binder based on an alkali silicate, contains 0.1% to 10% of sodium hydroxide as well as an addition of between 0.1% and 3% by weight of a suspension with a solids content of between 30% and 70% of amorphous $SiO_2$ beads. Microwave energy is used to dry the moulding material mixtures that are produced thereby.

CN 1721103 A discloses an inorganic binder for moulded part production with an improved disintegration behaviour after casting the cast parts. The binder contains dextrose powder, calcium carbonate powder, a suspension agent and further additives.

DE 10 2007 023 883 A1 discloses a shot gas supply device for supplying a core shooter with a moist gas with a specific moisture content, wherein the temperature of this gas can also be varied. A microwave emitter can be used to control the temperature of the moist gas.

EP 2 163 328 A1 discloses a process in which the basic moulding material is coated with between 0.25% and 0.9% with respect to the total weight of the moulding material of a water glass binder; the binder additionally contains at least one additive from the group formed by bonding agents, flow improvers, surface improving agents, drying agents or separating agents. The moulding material mixture also contains at least one hardener which, for example, hardens in contact with steam. Hardening of the moulded parts produced is carried out in a heated moulding die which is preferably heated to temperatures between 60° C. and 120° C.

EP 1 095 719 A2 discloses a binder system for moulding sands for the production of cores. The binder system based on water glass consists of an aqueous alkali silicate solution and a hygroscopic base such as sodium hydroxide, for example, which is used in a ratio of 1:4 to 1:6. The water glass has a $SiO_2/M_2O$ modulus of 2.5 to 3.5 and a solids content of 20% to 40%. In order to obtain a moulding mixture which can be poured and which can also be used to fill complicated core moulds, and also to control the hygroscopic properties, the binder system also contains a surfactant such as silicone oil, which has a boiling point of ≥250° C. The binder system is mixed with a suitable refractory material such as quartz sand, and can then be shot with a core shot machine into the core box. Hardening of the moulding material mixture is carried out by removal of the water it still contains. Drying or hardening of the casting mould may be carried out with the aid of microwaves.

WO 2006/024540 A2 describes that the strength of casting moulds both directly after moulding and hardening and also during storage under increased humidity can be substantially improved by using a binder which contains an alkali water glass as well as a particulate metallic oxide which is selected from the group silicon dioxide, aluminium oxide, titanium oxide and zirconium oxide. The particle size of these metallic oxides is preferably less than 300 μm, particularly preferably less than 100 μm. When producing the moulding material mixture, in general, the refractory basic moulding material is initially provided, and then the binder is added, with stirring. In this regard, the water glass as well as the particulate metallic oxide can be added in any order. However, advantageously, the liquid component is added first. The disadvantage here is that with this moulding material system too, heated moulding dies have to be used.

SUMMARY

The invention relates to a method for producing lost cores or moulded parts for the production of cast parts, in which a basic moulding material is mixed with an alkali silicate or water glass binder and a lost core or a moulded part for the production of cast parts is formed using a core shooter in a core box. The alkali silicate or water glass binder contains an alkali silicate or water glass solution with a modulus of 1.5 to 3.5 and natural and/or synthetic additives in a proportion of 0.1% to 25% by weight with respect to the total quantity of binder, with a particle size of less than 5 μm and wherein the natural and/or synthetic additives are at least aluminium silicate, magnesium silicate and sodium aluminium silicate, each in a proportion of 1% to 5% by weight with respect to the total quantity of binder. The lost core or the other moulded part is moulded in an unheated core box, and the lost core or the moulded part which is moulded in this manner is hardened using hot air.

DETAILED DESCRIPTION

The problem with current core production processes for the production of qualitatively high value and geometrically complicated lost cores is that either binders, catalysts and hardening gases (amine-air mixture or sulphur dioxide), which are harmful to health and to the environment, have to be used, or expensive metallic core boxes, as a rule produced from steel, which also have to be heated and therefore consume a lot of energy, have to be used.

The aim of the present invention is to develop a method for the production of lost cores or moulded parts for casting moulds which allows complicated moulded lost cores or moulded parts to be produced using inorganic binder systems with an environmentally and site-friendly binder system using moulding dies formed from wood, plastic, metal or combinations thereof without active heating.

In accordance with the invention, the aim is achieved by means of a method for producing lost cores or moulded parts for the production of cast parts, in which a basic moulding material is mixed with an alkali silicate or water glass binder and a lost core or a moulded part for cast parts is formed using a core shooter in a core box and is characterized in that the alkali silicate or water glass binder contains an alkali silicate or water glass solution with a modulus of 1.5 to 3.5 and natural and/or synthetic additives in a proportion of 0.1% to 25% by weight with respect to the total quantity of binder, with a particle size of less than 5 μm and wherein the natural and/or synthetic additives are at least aluminium silicate, magnesium silicate and sodium aluminium silicate, each in a proportion of 1% to 5% by weight with respect to the total quantity of binder, in that the lost core or the moulded part is moulded in an unheated core box, and in that the lost core or moulded part which is moulded in this manner is hardened using hot air.

In this regard, with the usual sands, a modified alkali silicate or water glass solution is used as the binder for the basic moulding material, wherein in accordance with the invention, the binder contains additives based on natural or synthetic minerals with a grain size of less than 5 μm and wherein the lost core which is produced with the core shooter is hardened with hot air which may be enriched with $CO_2$.

The term "lost cores" as used in the present invention means moulded parts which are used in the production of cast parts in order to function, for example, as spacers for complex shapes, usually voids, in a cast part. These on the one hand have to be solid and stable enough to retain their shape during the casting procedure, and on the other hand they must be able to be removed easily from the prepared cast part after the casting procedure and cooling of the cast part. For this reason, the lost cores consist of a basic moulding material and a binder which provides sufficient stability to comply with the above requirements.

The term "moulded parts" as used in the present invention means parts of a casting mould the external shape of which corresponds, for example, to that of the subsequently cast part.

The term "water glass solution" is not a unitary chemical compound, but rather a collective term for glass-like solidified melts of alkali silicates with a variable composition in solution. Aqueous alkali silicate solutions are known as water glass solutions to the person skilled in the art. Water glass solutions generally have the composition $xSiO_2*yM_2O*zH_2O$, wherein M is an alkali metal, preferably selected from sodium, potassium and lithium. The ratio of silicon dioxide to alkaline oxide is termed the modulus. The modulus describes the molar ratio of the two-components.

In accordance with the invention, the binder ensures that the basic moulding material mixture retains its desired shape and forms a lost core or a moulded part after hardening of the binder. In this regard, the lost core or the moulded part should remain stable in shape at least until the cast part has solidified and cooled to an extent that it does not undergo any further deformation. In this regard, the binder may be a single or multi-component system, i.e. it may be mixed together shortly before use or be present as a ready-to-use formulation.

A binder based on sodium, potassium and lithium silicates as well as sodium, potassium or lithium hydroxide or combinations thereof is used.

The fine-grained natural and/or synthetic additives are contained in the binder in proportions of 0.1% to 25% by weight, preferably in proportions of 0.5% to 15% by weight. The proportion of binder in the moulding material mixture during production of the core is less than 5% by weight, and is preferably 0.5% to 3.5% by weight, particularly preferably 1.0% to 2.0% by weight.

Preferably, the natural and/or synthetic additives have a grain size of less than 5 μm, which advantageously prevents settling of the additives in the binder. In this manner, the binder can be stored for several months, or for at least 2 months.

A core shooter is a machine for producing lost cores. The person skilled in the art will be familiar with conventional core shooters. The core shooter serves to shoot the basic moulding material mixed with binder into a core box. Moulds are termed core boxes when they provide the lost core with its subsequent shape. To this end, a basic moulding material mixed with binder is shot into a core box using a core shooter under pressure and is hardened therein. Advantageously, the core box of the invention is not heated, which means that the material of the core box can be selected from plastic, wood and metal or metal alloys, for example aluminium. The core box is at ambient temperature, at least for the first use. Advantageously, this means that energy is saved, since it is not necessary to heat up an entire core box initially and to keep it permanently warm throughout the period it is being used. In a particular embodiment of the invention, the core box is produced from a material which can be heated up, preferably from steel. Advantageously, the core box heats up when the lost mould is hardened using hot air, which thus contributes to faster hardening of the subsequent lost core in these core boxes. The term "air" in the context of the invention means the natural mixture of gases in the atmosphere of the Earth; its composition varies slightly and is known to the person skilled in the art; its main components are at least nitrogen, oxygen, argon and small proportions of other noble gases, for example, as well as carbon dioxide.

Preferably, the aluminium silicate is natural aluminium silicate, the magnesium silicate is a natural magnesium silicate and the sodium aluminium silicate is a synthetic sodium aluminium silicate. The person skilled in the art will be aware of the various sources and types of natural and synthetic additives.

Preferably, the binder is mixed with the basic moulding material in proportions of less than 5% by weight with respect to the quantity of basic moulding material.

Preferably, the basic moulding material is at least one sand selected from quartz, zirconia, chromite, olivine, feldspar, mullite, fireclay, bauxite or rutile sand. The person skilled in the art will be aware of other suitable sands for use as the basic material for the production of lost cores or moulded parts. The term "sand" as used in the invention means any mineral substance with a grain diameter in the range 0.02 to 2 mm.

Preferably, the binder contains at least one other natural and/or synthetic additive selected from zirconium silicate, aluminium oxide, aluminium hydroxide, magnesium oxide, magnesium hydroxide, titanium oxide, titanium hydroxide, sodium aluminate, potassium aluminate, lithium aluminate, sodium germanate, potassium germanate, lithium germanate, aluminium silicate, magnesium silicate, aluminium magnesium silicate, magnesium iron silicate, iron oxide, iron hydroxide and silicon dioxide in respective proportions of 0 to 3% by weight with respect to the total quantity of the binder.

The natural or synthetic materials added to the binder system may contain aluminium oxide, aluminium hydroxide, magnesium oxide, magnesium hydroxide, titanium oxide, titanium hydroxide, sodium aluminate, potassium aluminate or lithium aluminate, sodium germanate, potassium germanate, lithium germanate, aluminium silicate, magnesium silicate, aluminium magnesium silicate, magnesium iron silicate, iron oxide, iron hydroxide or silicon dioxide. The following materials are particularly suitable: magnesium hydroxide, lithium aluminate, aluminium silicate, magnesium silicate, aluminium magnesium silicate and/or silicon dioxide.

Preferably, a single-component binder is used as the alkali silicate or water glass binder.

As used in the present invention, the term "single-component binder" means a single-component system. The term "single-component systems" means that all of the components which are required for subsequent binding or hardening of the binder (single-component system) are already contained in the single-component binder. Mixing prior to this use is thus advantageously no longer necessary.

Preferably, to harden with hot air, a hot air generator is used which is mechanically integrated into or pressure-sealed with the core shooter.

Hot air generators are devices which can heat air and other gases or mixtures of gases to a desired temperature by sucking them in and guiding them through the heated device. The person skilled in the art will be familiar with a variety of hot air generators.

Advantageously, heat losses are minimized by integrating the hot air generator into or with the core shooter or by having it in its immediate vicinity.

Advantageously, the moulding material mixture, mixed with the binder, is hardened by contact with hot air to form a lost core or moulded part.

Preferably, the hot air generator is linked to the core shooter by means of a permanent mechanical connection.

As an example, the hot air generator and core shooter may be connected via a fixed line or a flexible tube. The person skilled in the art will be familiar with methods for linking the two pieces of equipment.

Preferably, the control of the hot air generator is integrated with that of the core shooter.

Preferably, the hot air is used at a temperature of up to 500° C., particularly preferably 150° C. to 300° C., more particularly preferably 150° C. to 200° C.

In a particular embodiment of the method of the invention, the hot air is used with a carbon dioxide content in the range 5% to 99% by volume, particularly preferably in the range 30% to 96% by volume, more particularly preferably 65% to 96% by volume, with respect to the total proportion of the air.

The degree of hardening can be increased by means of the carbon dioxide proportion.

In a particular embodiment of the invention, pure carbon dioxide is used to harden the binder.

Preferably, hot air is used with a volume flow of up to 40000 L/min, particularly preferably a volume flow of 20000 L/min up to 35000 L/min in order to harden the binder.

Preferably, the hot air is used at a pressure of up to 10 bar, preferably at a pressure of 2 to 5 bar, more particularly preferably at a pressure of 2 to 4 bar.

Preferably, hardening is carried out with hot air for 15 to 200 s, particularly preferably for 30 to 90 s, more particularly preferably for 30 to 60 s.

Advantageously, the lost core can be hardened in a short period of time with a relatively low energy consumption. Heating the whole core box, as is known in the prior art, requires a much higher energy consumption.

Preferably, directional aspiration of the hot air is carried out by means of a negative pressure of up to 1 bar.

After hardening, the solid lost core or the moulded part is removed from the core box and used for the production of cast parts.

For hardening, a hot air generator is mechanically integrated into or pressure sealed with a core shooter or in its' immediate vicinity in order to minimize heat losses. Preferably, the hot air generator is integrated by means of a permanent mechanical connection with the core shooter. Control of the hot air generator is integrated with that of the core shooter.

During hardening, hot air at a temperature of up to 500° C. and a positive pressure of up to 10 bar is used. The hot air can also be sucked through using a negative pressure of up to 1 bar. The volume flow rate is controlled and adjusted to be in the region of up to 40000 L/min.

The method of the invention enables the production of lost cores or moulded parts for casting moulds using an environmentally and workplace-friendly binder system.

In an advantageous embodiment of the invention, the binder system is a single-component system, which is simpler to use. In addition, the binder is used in small quantities; preferably, 2% by weight of binder with respect to the weight of the basic moulding material is sufficient. Using unheated core boxes on the one hand saves energy and costs, and on the other hand, core boxes can also be used which are produced from heat-sensitive materials. Advantageously, in addition to high primary strength, the lost cores or moulded parts produced using the method of the invention also have a low secondary strength following casting. The term "primary strength" as used in the invention means the strength of the lost cores or moulded parts following production. Preferably, the primary strength is high, so that the lost cores or moulded parts can be stored for long periods and they do not disintegrate during use. The term "secondary strength" in the context of the invention means the strength after producing a cast part with the aid of a lost core or moulded part. Preferably, the secondary strength is low, so that the lost core or the moulded part can be removed from the casting mould quickly and easily.

The invention also encompasses an alkali or water glass binder for binding a basic moulding material for lost cores or moulded parts for casting moulds for the purposes of cast part production, containing an alkali silicate or water glass solution with a modulus of 1.5 to 3.5 and natural and/or synthetic additives in a proportion of 0.1% to 25% by weight with respect to the total quantity of the binder, with a grain size of less than 5 μm, wherein the natural and/or synthetic additives are at least aluminium silicate, magnesium silicate and sodium aluminium silicate, respectively in an amount of up to 1% to 5% by weight with respect to the total quantity of the binder.

Advantageously, the binders in accordance with the invention have a high flowability and a low water uptake compared with known binders. Advantageously, lost cores or moulded parts can be produced with it which have a greater strength than that of conventional binders.

Preferably, the binder contains at least one further natural and/or synthetic additive selected from zirconium silicate, aluminium oxide, aluminium hydroxide, magnesium oxide, magnesium hydroxide, titanium oxide, titanium hydroxide, sodium aluminate, potassium aluminate, lithium aluminate, sodium germanate, potassium germanate, lithium germanate, aluminium silicate, magnesium silicate, aluminium magnesium silicate, magnesium iron silicate, iron oxide, iron hydroxide and silicon dioxide in a proportion of 0 to 3% by weight respectively with respect to the total quantity of the binder.

Preferably, the alkali silicate or water glass binder is a single-component binder.

Advantageously, in a single-component binder all of the components of the binder are present in a single formulation and do not have to be mixed together prior to using the binder, which means that the binder is easier to use.

The invention also encompasses the use of the alkali silicate or water glass binder for the production of lost cores or moulded parts for casting moulds for the production of cast parts.

DETAILED DESCRIPTION OF THE PREFERRED EMBODIMENTS

The invention will now be explained in more detail with the aid of the examples below, which do not in any way limit the scope of the invention.

EXAMPLE 1

Production of Lost Cores Using Known Binders

Quartz sand was used as the basic moulding material and was first mixed with a known binder as "old binder 1" and secondly mixed with a known binder as "old binder 2". Moulding material mixtures were produced with a basic moulding material proportion of 98% by weight and 98.5% by weight. The proportion of binder in the moulding material mixture was 2% by weight and 1.5% by weight. The term "% by weight" here refers to the total quantity of the mixture of basic moulding material and binder. A batch mixer was used for mixing. "Old binder 1" was a known alkali silicate binder with a modulus of 2.3 which contained only organic additives in small proportions (1.5% oxoanion, 0.5% polyol and 2% sodium hydroxide). "Old binder 2" was a known alkali silicate binder with a mod of 2.3 which contained additives in small proportions (1.5% oxoanion, 0.5% polyol and 2% sodium hydroxide) and 0.5% flow improver.

The prepared moulding material mixture was then transferred into the hopper of a core shooter (DISA Core EP 20). Next, the unheated core box was filled with the moulding material mixture by briefly (2 s) applying compressed air (2.5 bar).

Next, the core box was separated from the shooting head of the machine and a hot air generator (DISA, 8 kW power) was attached. Hot air under the temperature, pressure and time conditions shown in the tables was then passed through the moulded lost core.

After the hot air had been passed through, the core box was separated from the heat source and removed from the core shooter. After opening the core box, the lost core could be removed and processed further.

EXAMPLE 2

Production of Lost Cores with Alkali Silicate or Water Glass Single-component Binders in Accordance with the Invention In order to produce the lost cores, quartz sand was used as the basic moulding material. The quartz sand was mixed in a proportion of 98% by weight with 2.0% by weight of binder and in a second test with 98.5% quartz sand and 1.5% binder using a batch mixer. The single-component binders used were water glass solutions (modulus 2.0 to 3.5) with the following additives:

Novel Binder 1

Water glass solution modulus 2.3

Total quantity of additive 3.6% by weight

Proportion of additives 3% by weight aluminium silicate, 1% by weight sodium aluminium silicate, <1% by weight zirconium silicate, with respect to the total quantity of additive.

Novel Binder 2

Water glass solution modulus 2.3

Total quantity of additive 3.9% by weight

Proportion of additives 3% by weight aluminium silicate, 1% by weight sodium aluminium silicate, 2% by weight magnesium silicate, <1% by weight zirconium silicate, with respect to the total quantity of additive.

Novel Binder 3

Water glass solution modulus 2.5

Total quantity of additive 5.2% by weight

Proportion of additives 3% by weight aluminium silicate, 1% by weight sodium aluminium silicate, 2% by weight magnesium silicate, <1% by weight zirconium silicate, with respect to the total quantity of additive.

The lost cores were produced and gassed in accordance with the methods described in Example 1.

The lost cores obtained in accordance with Examples 1 and 2 were tested in respect of their bending strength, compressive strength and residual compressive strength. The following properties were determined:

The compressive strength was determined using cylindrical test pieces (preferably 50 mm in diameter and 50 mm in height). To this end, the test piece was placed with its front face between two fixed and one movable pressure disks and then loaded. The force displayed at break of the test piece and its cross section was recorded as the compressive strength in $N/cm^2$. The compressive strength was determined in accordance with the VDG (German Association of Foundry Professionals) technical note "Testing clay-bonded moulding materials—determination of strengths", Issue 2, P38, April 1988.

The residual compressive strength was determined in a manner analogous to that of the compressive strength.

The bending strength was determined in accordance with DIN 52404 and with the regulations for determining the bending strength contained in the VDG (German Association of Foundry Professionals) technical note "Binder testing—Testing of cold-hardening, resin-bonded moist moulding materials with aerosol and/or gas hardening", P73, August 1972.

Tables 1 and 2 document the values for bending strength and compressive strength for Examples 1 and 2. The bending strength and compressive strength were determined using Multisery LRu-2e universal strength testing equipment.

Table 3 documents the values for the residual compressive strength for Examples 1 and 2 after simulated casting at 400° C. and at 800° C.

Tables 4 and 9 document the test values obtained using novel binder 1 with a binder content of 1.5% by weight and 2.0% by weight with different gassing temperatures and periods.

Test conditions for Tables 4-9: shot pressure 2.5 bar, shot period 2.0 s, bending strength test using bending rig, the times in the table provide the test time after removal of test piece from the core box; for the residual compressive strength, the specimens were annealed for 20 min at test temperature, tested 1 hour after end of the annealing treatment; all measurements are given as the mean of 3 individual measurements.

For all of the examples, Haltern H32 quartz sand was used.

TABLE 1

Bending strength measurements
Shot pressure 2.5 bar, shot period 2 s, air temperature 150° C., pressure 2 bar, 3 minutes hardening time, mean of 5 measurements

| Type of binder - quantity of binder in basic moulding mixture [wt %] | Immediately in N/cm$^2$ | After 1 h in N/cm$^2$ | After 24 h in N/cm$^2$ |
|---|---|---|---|
| old binder 1 - 1.5 wt % | 95 | 140 | 147.5 |
| old binder 2 - 1.5 wt % | 113 | 134 | 155 |
| novel binder 1 - 1.5 wt % | 173 | 240 | 246.6 |
| novel binder 2 - 1.5 wt % | 156 | 206.2 | 212 |
| novel binder 3 - 1.5 wt % | 151 | 184.2 | 190 |
| old binder 1 - 2 wt % | 179 | 230 | 137.5 |
| old binder 2 - 2 wt % | 218 | 245 | 257.5 |
| novel binder 1 - 2 wt % | 269 | 334.2 | 345.8 |
| novel binder 2 - 2 wt % | 240 | 275 | 285 |
| novel binder 3 - 2 wt % | 214 | 247.5 | 274.2 |

TABLE 2

Compressive strength measurements
Shot pressure 2 bar, shot period 1.5 s, air temperature 150° C., pressure 1.5 bar, 2 minutes hardening time, mean of 3 individual measurements

| Type of binder - quantity of binder in basic moulding mixture [wt %] | After 1 h in N/cm$^2$ | After 24 h in N/cm$^2$ |
|---|---|---|
| old binder 1 - 1.5 wt % | 76.1 | 144.0 |
| old binder 2 - 1.5 wt % | 237.7 | 284.9 |
| novel binder 1 - 1.5 wt % | 273.0 | 328.2 |
| novel binder 2 - 1.5 wt % | 253.0 | 353.8 |
| novel binder 3 - 1.5 wt % | 164.2 | 188.1 |
| old binder 1 - 2 wt % | 223.2 | 276.6 |
| old binder 2 - 2 wt % | 263.1 | 337.2 |
| novel binder 1 - 2 wt % | 270.6 | 402.0 |
| novel binder 2 - 2 wt % | 279.4 | 355.7 |
| novel binder 3 - 2 wt % | 261.4 | 369.8 |

TABLE 3

Residual compressive strength measurements
Shot pressure 2 bar, shot period 1.5 s, air temperature 150° C., pressure 1.5 bar, 2 minutes hardening time, mean of 3 individual measurements, load at test temperature 20 min, test after cooling

| Type of binder - quantity of binder in basic moulding mixture [wt %] | After 400° C. in N/cm$^2$ | After 800° C. in N/cm$^2$ |
|---|---|---|
| old binder 1 - 1.5 wt % | 8.3 | 10.2 |
| old binder 2 - 1.5 wt % | 17.6 | 59.8 |
| novel binder 1 - 1.5 wt % | 15.5 | 48.1 |
| novel binder 2 - 1.5 wt % | 11.9 | 65.8 |
| novel binder 3 - 1.5 wt % | 8.4 | 18.7 |
| old binder 1 - 2 wt % | 15.9 | 29.0 |
| old binder 2 - 2 wt % | 25.7 | 135.8 |
| novel binder 1 - 2 wt % | 15.1 | 56.7 |
| novel binder 2 - 2 wt % | 10.1 | 17.0 |
| novel binder 3 - 2 wt % | 10.4 | 54.2 |

TABLE 4

Novel binder 1 - binder content 1.5 wt % - gassing temperature: 170° C.

| Gassing | Bending strength [N/cm$^2$] | | | | Residual compressive strength | |
|---|---|---|---|---|---|---|
| period | immediatel | after 1 h | after 24 h | after 48 h | 400° C. | 800° C. |
| 3 | 233 | 233 | 182 | 182 | 28 | 0 |
| 2 | 212 | 217 | 232 | 193 | 28 | 8 |
| 1 | 162 | 210 | 200 | 208 | 0 | 0 |

TABLE 5

Novel binder 1 - binder content 1.5 wt % - gassing temperature: 160° C.

| Gassing | Bending strength [N/cm$^2$] | | | | Residual compressive strength | |
|---|---|---|---|---|---|---|
| period | immediatel | after 1 h | after 24 h | after 48 h | 400° C. | 800° C. |
| 3 | 200 | 200 | 200 | 190 | 30 | 0 |
| 2 | 120 | 107 | 163 | 137 | 0 | 0 |
| 1 | 150 | 123 | 140 | 157 | 7 | 0 |

TABLE 6

Novel binder 1 - binder content 1.5 wt % - gassing temperature: 150° C.

| Gassing | Bending strength [N/cm$^2$] | | | | Residual compressive strength | |
|---|---|---|---|---|---|---|
| period | immediatel | after 1 h | after 24 h | after 48 h | 400° C. | 800° C. |
| 3 | 215 | 202 | 193 | 157 | 23 | 13 |
| 2 | 212 | 197 | 190 | 187 | 23 | 12 |
| 1 | 193 | 198 | 170 | 155 | 27 | 7 |

TABLE 7

Novel binder 1 - binder content 2.0 wt % - gassing temperature: 170° C.

| Gassing | Bending strength [N/cm$^2$] | | | | Residual compressive strength | |
|---|---|---|---|---|---|---|
| period | immediatel | after 1 h | after 24 h | after 48 h | 400° C. | 800° C. |
| 3 | 280 | 270 | 255 | 255 | 7 | 0 |
| 2 | 267 | 300 | 243 | 235 | 28 | 7 |
| 1 | 157 | 253 | 273 | 240 | 30 | 13 |

TABLE 8

| Novel binder 1 - binder content 2.0 wt % - gassing temperature: 160° C. | | | | | | |
|---|---|---|---|---|---|---|
| | Bending strength [N/cm²] | | | | Residual compressive strength | |
| Gassing period | immediatel | after 1 h | after 24 h | after 48 h | 400° C. | 800° C. |
| 3 | 253 | 313 | 252 | 267 | 0 | 0 |
| 2 | 207 | 207 | 263 | 232 | 23 | 20 |
| 1 | 170 | 260 | 254 | 197 | 28 | 7 |

TABLE 9

| Novel binder 1 - binder content 2.0 wt % - gassing temperature: 150° C. | | | | | | |
|---|---|---|---|---|---|---|
| | Bending strength [N/cm²] | | | | Residual compressive strength | |
| Gassing period | immediatel | after 1 h | after 24 h | after 48 h | 400° C. | 800° C. |
| 3 | 277 | 317 | 237 | 253 | 22 | 0 |
| 2 | 260 | 237 | 252 | 240 | 23 | 17 |
| 1 | 137 | 270 | 205 | 240 | 20 | 7 |

The tests show that the single-component binder of the invention can be used in smaller proportions in the moulding material mixture than is usual with conventional binder systems of the prior art.

Despite the smaller proportions of single-component binder of 1.5% to 2% by weight with respect to the quantity of basic moulding material employed, lost cores with strength properties which are at least as good are obtained. To illustrate this, lost cores or moulded articles were produced with known binders ("old binder 1" and "old binder 2") with the same low proportions of binders.

Table 1 shows the bending strengths of the lost cores. It is clear that the lost cores produced with the single-component binder of the invention exhibit substantially better bending strengths both immediately and also after 1 h and after 24 h than lost cores produced with conventional binders. This trend is also discernible with the compressive strengths.

The test values in Tables 4 to 9 document the fact that with binder proportions of 1.5% and 2.0% by weight at gassing temperatures of 150-170° C. and gassing periods of 1 to 3 minutes, both very high values for the bending strength and also very low values for the residual compressive strength are obtained. This behaviour, detected on test pieces, is very close to the practical demands for a primary strength which is as high as possible and for very low secondary strengths (ideally 0).

The invention claimed is:

1. A method for producing lost cores or moulded parts for the production of cast parts, in which a basic moulding material is mixed with an alkali silicate or water glass binder and each lost core or a moulded part for the production of cast parts is formed using a core shooter in a core box, characterized in that the alkali silicate or water glass binder contains an alkali silicate or water glass solution with a modulus of 1.5 to 3.5 and natural and/or synthetic additives in a proportion of 0.1% to 25% by weight with respect to a total quantity of the binder, with a particle size of less than 5 μm and wherein the natural and/or synthetic additives are at least aluminium silicate, magnesium silicate and sodium aluminium silicate, each in a proportion of 1% to 5% by weight with respect to the total quantity of binder, in that the lost core or the other moulded part is moulded in an unheated core box, and in that the lost core or the moulded part which is moulded in this manner is hardened using hot air.

2. The method as claimed in claim 1, characterized in that the binder is mixed with the basic moulding material in proportions of less than 5% by weight with respect to a quantity of the basic moulding material.

3. The method as claimed in claim 1, characterized in that the basic moulding material is at least one sand selected from quartz, zirconium, chromite, olivine, feldspar, mullite, fireclay, bauxite or rutile sand.

4. The method as claimed in claim 1, characterized in that the binder contains at least one further natural and/or synthetic additive selected from zirconium silicate, aluminium oxide, aluminium hydroxide, magnesium oxide, magnesium hydroxide, titanium oxide, titanium hydroxide, sodium aluminate, potassium aluminate, lithium aluminate, sodium germanate, potassium germanate, lithium germanate, aluminium silicate, magnesium silicate, aluminium magnesium silicate, magnesium iron silicate, iron oxide, iron hydroxide and silicon dioxide in a proportion of up to 3% by weight respectively with respect to the total quantity of the binder.

5. The method as claimed in claim 1, characterized in that the alkali silicate or water glass binder is used as a single-component binder.

6. The method as claimed in claim 1, characterized in that a hot air generator is used for hardening with hot air, which is mechanically integrated into or pressure-sealed with the core shooter.

7. The method as claimed in claim 1, characterized in that the hot air generator is connected with the core shooter by means of a permanent mechanical connection.

8. The method as claimed in claim 1, characterized in that control of the hot air generator is integrated with that of the core shooter.

9. The method as claimed in claim 1, characterized in that the hot air is used at a temperature of up to 500° C.

10. The method as claimed in claim 1, characterized in that the hot air is used with a carbon dioxide content of 5% to 99% by volume with respect to a total quantity of air.

11. The method as claimed in claim 1, characterized in that the hot air is used with a volume flow of up to 40000 L/min.

12. The method as claimed in claim 1, characterized in that the hot air is used at a pressure of up to 10 bar.

13. The method as claimed in claim 1, characterized in that hardening with the hot air is carried out for 15 to 200 s.

14. The method as claimed in claim 1, characterized in that a specific suction of the hot air is carried out by means of a negative pressure of up to 1 bar.

15. An alkali or water glass binder for binding a basic moulding material for lost cores or moulded parts for casting moulds for the purposes of cast part production, containing an alkali silicate or water glass solution with a modulus of 1.5 to 3.5 and natural and/or synthetic additives in a proportion of 0.1% to 25% by weight with respect to a total quantity of the binder, with a grain size of less than 5 μm, wherein the natural and/or synthetic additives are at least aluminum silicate, magnesium silicate and sodium aluminium silicate, respectively in an amount of up to 1% to 5% by weight with respect to the total quantity of the binder.

16. The binder as claimed in claim 15, characterized in that the binder contains at least one further natural and/or synthetic additive selected from zirconium silicate, aluminium oxide, aluminium hydroxide, magnesium oxide, magnesium hydroxide, titanium oxide, titanium hydroxide, sodium aluminate, potassium aluminate, lithium aluminate, sodium germanate, potassium germanate, lithium germanate, aluminium silicate, magnesium silicate, aluminium magnesium silicate, magnesium iron silicate, iron oxide, iron hydroxide and silicon dioxide in a proportion of up to 3% by weight respectively with respect to the total quantity of the binder.

17. The binder as claimed in claim 15, characterized in that the alkali silicate or water glass binder is a single-component binder.

* * * * *